US010786913B2

(12) United States Patent
Krauss et al.

(10) Patent No.: US 10,786,913 B2
(45) Date of Patent: Sep. 29, 2020

(54) ELECTRICALLY DRIVEN DEVICE

(71) Applicant: Braun GmbH, Kronberg (DE)

(72) Inventors: Joachim Krauss, Seeheim-Jugenheim (DE); Uwe Fischer, Darmstadt (DE); Roman Roeder, Oberursel (DE); Andreas Peter, Kronberg (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 16/361,672

(22) Filed: Mar. 22, 2019

(65) Prior Publication Data

US 2019/0291288 A1 Sep. 26, 2019

(30) Foreign Application Priority Data

Mar. 23, 2018 (EP) ..... 18163671

(51) Int. Cl.
*B26B 19/28* (2006.01)
*B26B 19/38* (2006.01)
(Continued)

(52) U.S. Cl.
CPC ..... *B26B 19/28* (2013.01); *B26B 19/048* (2013.01); *B26B 19/063* (2013.01); *B26B 19/10* (2013.01); *B26B 19/14* (2013.01); *B26B 19/3853* (2013.01)

(58) Field of Classification Search
CPC ..... B26B 19/28; B26B 19/063; B26B 19/048; B26B 19/10; B26B 19/14; B26B 19/3853;
(Continued)

(56) References Cited

U.S. PATENT DOCUMENTS 3,411,206 A * 11/1968 Showers, Jr. ..... B26B 19/28 30/43.91
3,589,005 A * 6/1971 Fischer et al. ..... B26B 19/102 30/34.1
(Continued)

FOREIGN PATENT DOCUMENTS

CN 204954885 U 1/2016
CN 110299795 A 10/2019
(Continued)

OTHER PUBLICATIONS

Rattenberger, B.; European Search Report and Opinion dated Sep. 24, 2018; European Application No. 18163671.3; European Patent Office; Munich Germany.
(Continued)

*Primary Examiner* — Ghassem Alie
(74) *Attorney, Agent, or Firm* — Kevin C. Johnson; Gerd Zetterer

(57) ABSTRACT

An electrically driven device having a housing, an application head movably mounted on the housing, an electric motor mounted in the housing and including a drive shaft having a first rotary axis, a driven shaft for performing a movement relative to the housing, the driven shaft extending at least partially within the application head, and a first actuation member and a second actuation member. The actuation members are movably guided in the application head and wherein the first actuation member comprises a seat receiving a portion of the driven shaft for driving the first actuation member in the first direction.

15 Claims, 2 Drawing Sheets

(51) Int. Cl.

| | |
|---|---|
| ***B26B 19/06*** | (2006.01) |
| ***B26B 19/14*** | (2006.01) |
| ***B26B 19/10*** | (2006.01) |
| ***B26B 19/04*** | (2006.01) |

(58) Field of Classification Search

CPC ..... B26B 19/288; B26B 19/046; B26B 19/04; B26B 19/38; B26B 19/102

USPC ..... 30/45, 43.91, 42, 43.7–46, 527, 43.92, 30/43.9, 34.1, 43.5, 43.8, 346.51, 225, 30/216, 43.6, 9

See application file for complete search history.

(56) References Cited

U.S. PATENT DOCUMENTS

| | | | | |
|---|---|---|---|---|
| 3,967,372 | A * | 7/1976 | Beck | B26B 19/102 30/34.1 |
| 4,274,199 | A | 6/1981 | Gallanis et al. | |
| 5,557,850 | A | 9/1996 | Mun | |

FOREIGN PATENT DOCUMENTS

| | | | |
|---|---|---|---|
| DE | 1052266 | B | 3/1959 |
| DE | 3213099 | A1 | 10/1983 |
| EP | 1607196 | A1 | 12/2005 |
| EP | 2024147 | B1 | 2/2009 |
| EP | 3300861 | A1 | 4/2018 |
| EP | 3300862 | A1 | 4/2018 |
| EP | 3542975 | A1 | 9/2019 |
| JP | S53128094 | | 3/1977 |
| JP | H04220285 | A | 8/1992 |
| JP | H0654965 | A | 3/1994 |
| JP | H07185151 | A | 7/1995 |
| JP | 2017127394 | A | 7/2017 |
| JP | 2019166313 | A | 10/2019 |
| WO | 0151260 | A1 | 7/2001 |
| WO | 2018198640 | A1 | 11/2018 |

OTHER PUBLICATIONS

Japanese Search Report dated Jan. 22, 2020; Japanese Patent Application No. 2019-039690; Japanese Patent Office.

Notice of Reasons for Refusal dated Jan. 28, 2020; Japanese Patent Application No. 2019-039690; Japanese Patent Office.

* cited by examiner

ELECTRICALLY DRIVEN DEVICE

FIELD OF THE INVENTION

The present invention is concerned with an electrically driven device, for example an electric hair removal device, such as a dry shaver, an electric toothbrush or an electric skin treatment device.

BACKGROUND OF THE INVENTION

EP 2 024 147 B1 discloses an electric shaver comprising a housing, an electric motor mounted in the housing and comprising a drive shaft having a first rotary axis, a drive pin connected to the drive shaft eccentrically with respect to the rotary axis, and at least one driven shaft mounted in the housing for performing a movement relative to the housing. The driven shaft is indirectly coupled to the drive shaft by means of a gear mechanism converting a rotary motion of the drive shaft into a reciprocating motion of the driven shaft which in turn is coupled to a cutter element of the shaver.

Electrically driven devices with a gear mechanism converting a rotary motion of the drive shaft into a reciprocating motion of the driven shaft are well known in the shaver prior art.

In such dry foil shavers, the principle cutting process is to move a first actuation member in the form of a blade relative to a foil with a surface containing holes, through which the hair is fed into the cutting zone. For cutting longer hairs or for trimmers, a second actuation member in the form of a blade moves relative to a comb. Both elements have cutting teeth. The cutting parts are usually positioned in the shaving head and for special shaving jobs, the number of cutting parts and the kind of cutting part itself (foil, trimmer) may vary. For example, there are shavers with one single foil but also shavers with 5 or more cutting elements in the shaver head. To obtain a close, smooth and efficient shave, a shaver should contain at least 2 cutting elements.

To move the different cutting elements, most dry shavers use mechanical coupling elements to connect the drive unit of the shaver with the cutting elements. The drive unit either provides a movement, where the cutting parts move in the same direction or where they move (at least partly) in the opposite direction. Some shavers use a spring mass system to increase the amplitude of the cutting element.

In most known dry shavers, each actuation member (cutting element) has a respective coupling element, like a driven shaft or pin. Thus, the number of mechanical coupling elements is identical with the number of cutting parts in the shaver head. This basic principle of the mechanical coupling between the drive unit and each cutting element is a limitation for a scenario, where a shaver has a fixed number of couplings but should contain more cutting elements.

SUMMARY OF THE INVENTION

It is an object of the present disclosure to provide an electrically driven device permitting more flexibility regarding the design of the device. It is a further object to provide a device comprising at least two actuation members with a high dynamical stiffness.

This object is solved by an electrically driven device as defined in claim 1. In accordance with one aspect there is provided an electrically driven device comprising a housing, an application head movably mounted on the housing, an electric motor mounted in the housing and comprising a drive shaft having a first rotary axis, a driven shaft for performing a movement relative to the housing with the driven shaft extending at least partially within the application head wherein the driven shaft is indirectly coupled to the drive shaft by means of a gear mechanism converting a rotary motion of the drive shaft into a reciprocating motion of the driven shaft in a first direction, and a first actuation member and a second actuation member wherein the actuation members are movably guided in the application head and wherein the first actuation member comprises a seat receiving a portion of the driven shaft for driving the first actuation member in the first direction.

It is possible to combine both actuation members, e.g. cutting elements, with a single driven shaft if the first actuation member is coupled to the second actuation member by means of a connecting lever for driving the second actuation member in the first direction. While it is desirable that the first actuation member entrains the second actuation member regarding the movement in the first direction, relative movements between the actuation members may be desirable in other direction. This is permitted in that the connecting lever is pivotably mounted in the first actuation member and is pivotably mounted in the second actuation member.

Providing the connecting lever between two cutting elements or the like actuation members enables to choose between variable numbers of cutting elements in a shaving head, whereas the drive system contains only a limited number of driven shafts, e.g. one single driven shaft or two driven shafts. For example, this arrangement provides a platform approach which enables consumers to use various exchangeable key parts with different numbers of cutting elements for a drive system with a set number of driven shafts.

DETAILED DESCRIPTION OF THE INVENTION

Figure 1:
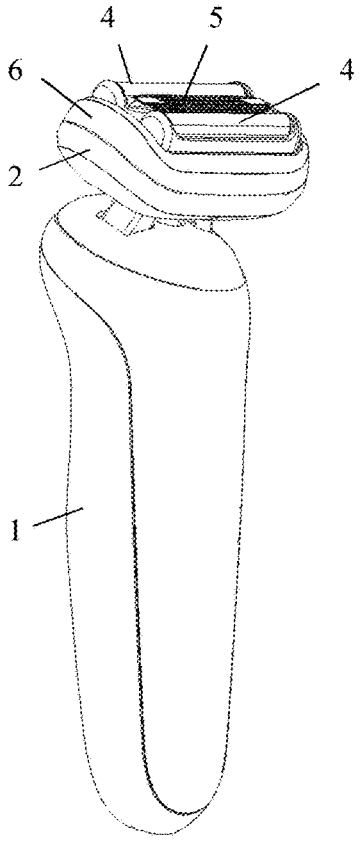
FIG. 1 shows a perspective view of a device according to a first embodiment.

Before describing advantageous embodiments of the invention related to the embodiments depicted in FIGS. 1 to 5*b*, different aspects of the invention are described more in detail. These aspects disclose further features, advantages and possibilities of use of the present invention that might be combined in any useful combination. All features described and/or shown in the drawings are subject matter of the invention, irrespective of the grouping of the features in the claims and/or their back references.

The connecting lever, preferably directly, connects the first actuation member to the second actuation member such that the reciprocating movement of the first actuation member is transferred onto the second actuation member. Typically, the actuation members perform during use a reciprocating linear movement guided in the application head. To prevent that the actuation members get jammed due to bending forces, it is desirable if the connecting lever extends, at least substantially, in the first direction, i.e. in the direction of movement of the actuation members.

In addition, the bearings for the connecting lever in the actuation members should be provided such that the bending forces are reduced to a minimum. Preferably, the connecting lever is pivotably mounted in the first actuation member by means of a pin extending substantially perpendicular to the first direction and/or the connecting lever is pivotably mounted in the second actuation member by means of a pin extending substantially perpendicular to the first direction. For example, each of the pins may be received in a bush bearing of the connecting lever and a bush bearing of the respective actuation member. Such a bush bearing may be an integral component part often actuation member or may be a separate component part rigidly attached to an actuation member.

To get a perfect adaptation of the cutting elements to the skin, the actuation members, e.g. cutting elements, are positioned in such a way, that the whole member can move perpendicular to the skin (float) or it can tilt in the direction of the cutting process or perpendicular to it. In addition to this movement of the single cutting element, some shavers allow a complete rotation of the head in two directions (swivel and tilt). The adaptation of the driven cutting element to the skin is enabled via the degrees of freedom the connection lever comes with. Whereas the driving movement/force is transferred efficiently the other degrees of freedom are defined in a way that an independent float or tilt movement of both cutting elements is permitted and the floating movement of one cutting element is not substantially influencing and/or constraining the other cutting element and vice versa.

For this purpose it is preferred if the connecting lever is pivotably mounted in the first actuation member at a lateral end portion of the first actuation member and is pivotably mounted in the second actuation member at a central portion of the second actuation member. In addition, the connecting lever is preferably relatively long to avoid shifting of the second actuation member in response to the floating or a tilting movement of the first actuation member. For example, the connecting lever has a length in the first direction being at least 40%, preferably about 50%, of the length of the first actuation member.

The gear mechanism of the electrically driven device may be designed and may function as defined in EP 16191091.4 and/or EP 16191093.0. In more detail, the gear mechanism preferably converts a continuous rotary motion of the drive shaft into an at least substantially sinusoidal reciprocating displacement driven shaft. For example, the driven shaft may be mounted on a pivotable bridge of the gear mechanism, wherein the bridge is pivotable about a second rotary axis which is offset with respect to the driven shaft.

The present disclosure is not limited to an electrically driven device having only one driven shaft and/or only to actuation members. For example, the device may be provided with at least one further driven shaft mounted on the bridge at an opposite position with respect to the second rotary axis. The at least one further driven shaft may be coupled to at least one further actuation member such that the at least one further actuation member is driven in the direction opposite direction of the first actuation member.

The pivotable bridge may be rotationally constrained to the at least one driven shaft. The at least one driven shaft and the pivotable bridge may be separate component parts or may alternatively form one single unitary component part. As a further alternative, the at least one driven shaft may be rotatable with respect to the pivotable bridge. Due to the arrangement of the at least one driven shaft on the pivotable bridge, a reciprocating pivoting of the pivotable bridge results in a back and forth movement of the at least one driven shaft. This back and forth movement of the at least one driven shaft is a movement on the circular path which is close to a linear movement.

The first rotary axis may be inclined with respect to the second rotary axis. In more detail, the eccentric drive pin of the motor may extend parallel to the first rotary axis and the intermediate shaft and the at least one driven shaft may extend parallel to the second rotary axis. With the electrically driven device being an electric shaver this arrangement permits to provide the shaver head (application head) inclined or angled with respect to the shaver body (housing). In addition, the gear mechanism with an intermediate shaft allows a design of a shaver or the like device with a constricted neck between a body portion and a head portion.

The adaptation of the driven cutting element to the skin may be improved by the first actuation member and/or the second actuation member being mounted in the application head movable in a floating direction which is perpendicular to the first direction and parallel to the driven shaft against the bias of an elastically deformable element, e.g. a spring. Such a floating or plunging movement is typically in a direction perpendicular to a user's skin.

In addition or as an alternative, the first actuation member and/or the second actuation member may be mounted in the application head movable in a tilting direction about an axis which is perpendicular to the first direction and perpendicular to the driven shaft against the bias of an elastically deformable element, e.g. a spring. Such a tilting movement may include a floating of an actuation member on only one side. Thus, with an actuation member guided on two lateral posts with spring members, floating and tilting of the actuation member is permitted.

Still further, the electrically driven device may comprise a bearing for the application head permitting a swiveling movement of the application head relative to the housing about an axis parallel to the first direction.

According to an embodiment of the present disclosure, the he electrically driven device is a dry shaver with the first actuation member being the lower cutter of a foil type cutter unit and/or the second actuation member being the lower cutter of a non-foil type cutter unit.

Due to the fact, that the cutting elements are subjected to mechanical wear, they may be arranged in an exchangeable part of the shaver, the so called keypart, which has to be replaced after the lifetime of the parts is passed. This keypart can be repurchased. For example, the first actuation member and/or the second actuation member is mounted in a frame which is detachably fixed at the application head. Preferably, the connecting lever is detachable from the application head together with the frame and the actuation members.

The housing of the electrically driven device may comprise a cap portion with an intermediate shaft extending through the cap portion. A sealing may be provided between the cap portion and the intermediate shaft. Taking into account that the intermediate shaft typically performs a reciprocating pivoting movement by a small angle, for example about 6°, the sealing may comprise an elastically deformable sleeve fixed to the cap portion and to the intermediate shaft. Such a sealing may contribute in closing off the housing or body portion of a shaver while a detachable shaver head may have to be cleaned in a cleaning liquid. For example, a sealing separating an inner sealed compartment of the motor and elements of the transmission (body) with an outer unsealed area where the cutting parts and/or the shaving cartridge is located.

The present disclosure proposes a solution to combine a higher number of cutting elements contained in the changing frame (spare part), i.e. the keypart, then driven shafts are provided from the shaver drive transmission. In one specific example the connecting lever between two cutting elements enables the user to choose between variable numbers of cutting elements in the shaving head, whereas the drive system contains only two driven shafts. This enables consumers to use various exchangeable keyparts with different numbers of cutting elements for a given two driven shafts system. The connecting lever is positioned in the keypart and therefore it allows a wide range of variety for the number of cutting elements in the keypart, whereas the drive system always contains the same number of mechanical couplings. The design and positioning of the connecting lever allows the use of a conventional drive system with oscillating bridges, linear motors or new drive generations e.g. rotating oscillating drives.

Turning now to the embodiment depicted in FIGS. 1 to 5*b*, the electrically driven device is a dry shaver having two driven shafts and three cutting elements. In more detail, the shaver comprises a shaver handle or housing 1 and a shaver head (application head) 2 mounted on the housing 1. The housing 1 comprises a motor 20 with a drive shaft 22, see FIG. 2, and e.g. a rechargeable battery (not shown). The drive shaft 22 defines a first rotary axis I, extending for example in the main direction of the housing 1. The drive shaft is coupled via a gear mechanism 24 to at least one driven shaft 3 thereby converting a rotary motion of the drive shaft into a reciprocating motion of the driven shaft in a first direction D1.

Figure 5A:
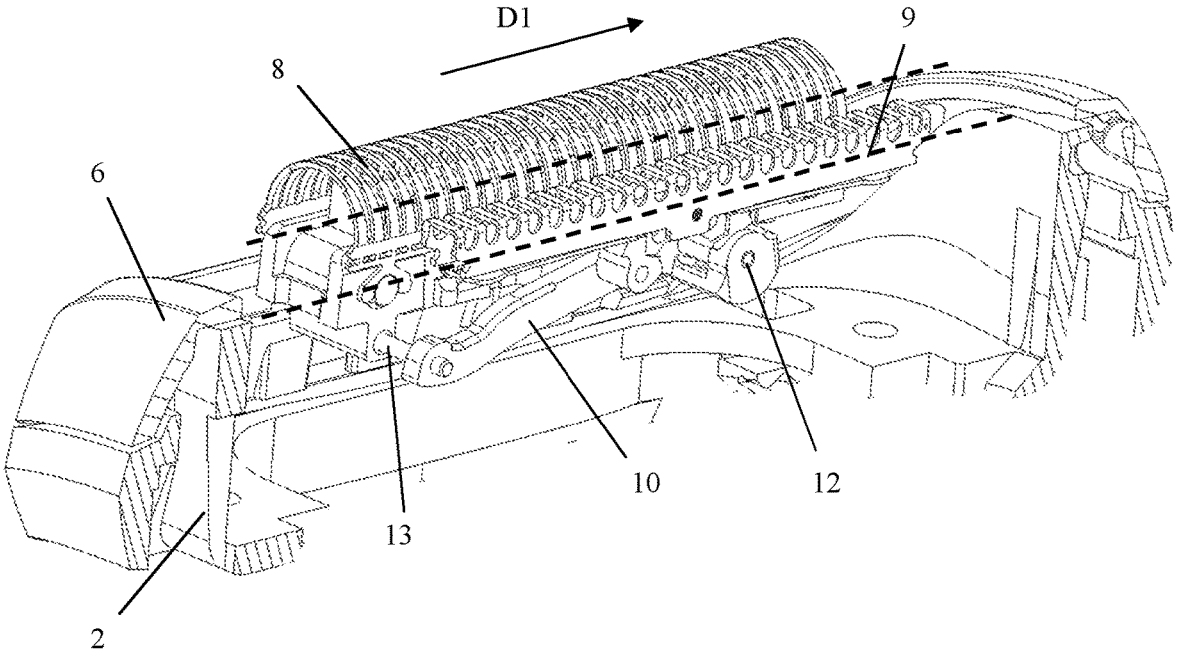
FIG. 5*a* shows a cut open view of a portion of the device of FIG. 1 in an idle state.
Figure 5B:
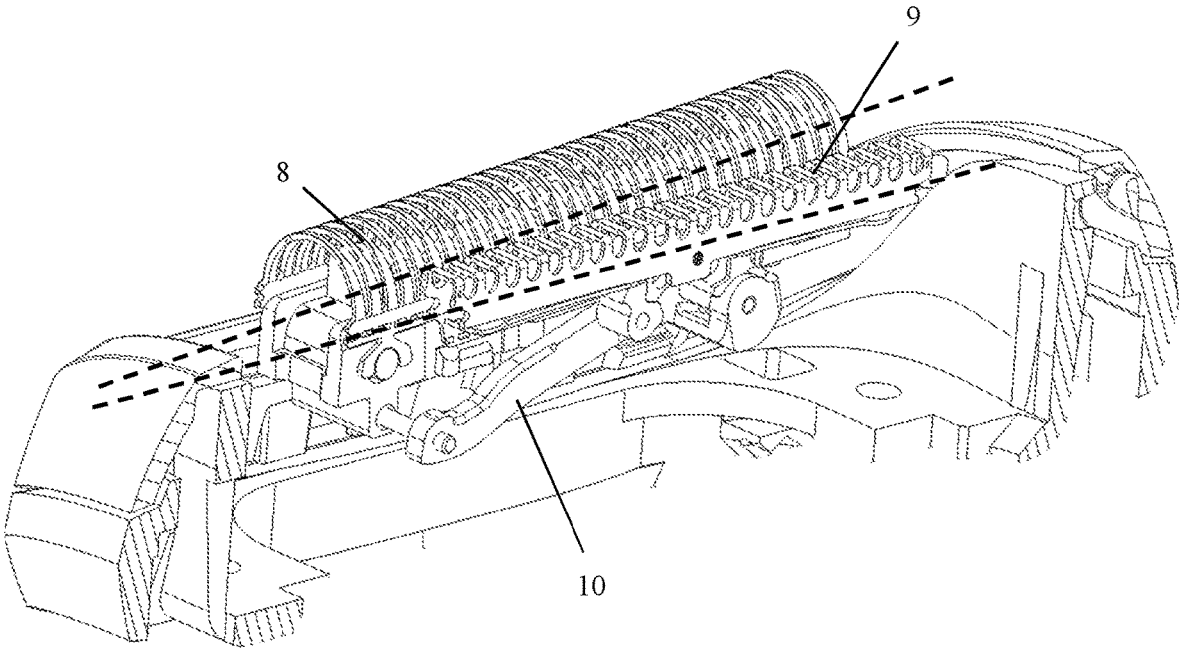
FIG. 5*b* shows a cut open view of a portion of the device of FIG. 1 with a tilted cutter.

In the embodiment depicted in FIG. 1, the dry shaver comprises two foil type cutter units 4 and one non-foil type cutter unit 5. As depicted in FIGS. 5*a* and 5*b* in more detail, the cutter units 4, 5 are provided in a frame 6 which is detachably mounted in the shaver head 2, thus permitting exchange of the cutter units. For example, the frame 6 may be releasably attached to the shaver head 2 by means of hooks engaging a spring element (not shown). Preferably, attachment of the frame 6 on the shaver head 2 simultaneously couples the driven shafts with the respective foil type cutter units 4.

Figure 2:
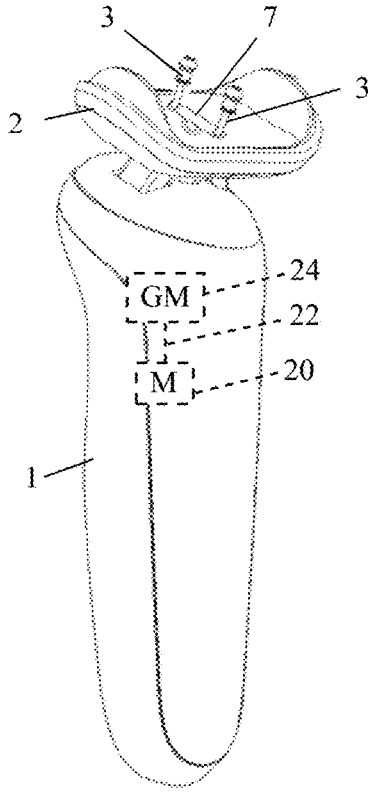
FIG. 2 shows the device of FIG. 1 with the head partially removed.
Figure 3:
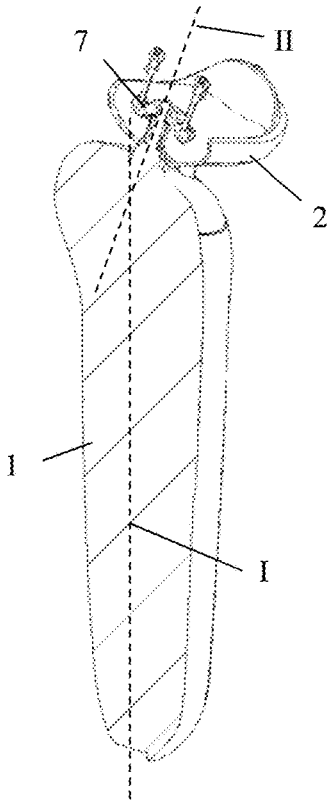
FIG. 3 shows a sectional view of FIG. 2.

In FIGS. 2 and 3 the frame with the cutter units is detached from the shaver head 2 such that the driven shafts 3 are visible. In the depicted embodiment the driven shafts 3 are mounted on a common pivotable bridge 7 which in turn may be mounted on an intermediate shaft defining a second rotary axis II which is inclined with respect to the first rotary axis I. This arrangement permits to provide the shaver head (application head) inclined or angled with respect to the shaver body (housing) in an optimal orientation for use.

Figure 4:
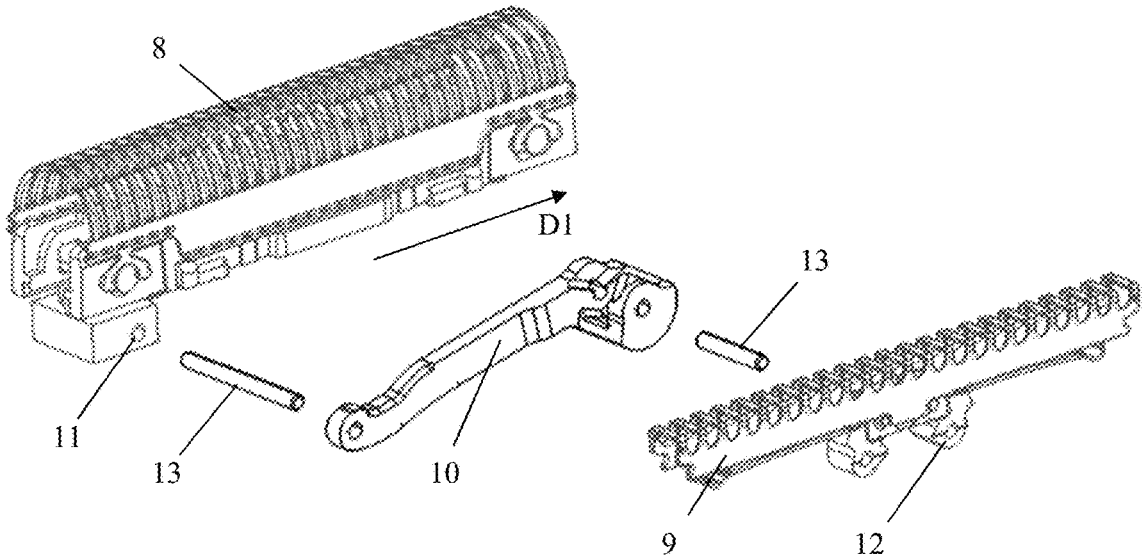
FIG. 4 shows a perspective view of component parts of the device of FIG. 1.

Each of the foil type cutter units 4 comprises an actuation member in the form of a lower cutter 8 movable relative to a fixed foil type upper cutter. The lower cutter 8 is guided in the frame 6 permitting reciprocating linear displacement of the lower cutter 8. Further, the non-foil type cutter unit 5 comprises a second actuation member in the form of a lower cutter 9 movable relative to a fixed comb type upper cutter. Each lower cutter 8 of the foil type cutter units 4 comprises a seat receiving a portion of the respective driven shaft 3 for driving the actuation member in the first direction. However, the lower cutter 9 of the non-foil type cutter unit 5 is not directly connected to the driven shaft 3. Rather, the lower cutter 9 of the non-foil type cutter unit 5 is connected to one of the lower cutters 8 of a foil type cutter unit 4 by means of the connecting lever 10 as shown in FIGS. 4 to 5*b*.

For this purpose, a bush bearing 11 is provided near a lower lateral end portion of the lower cutter 8 and a further bush bearing 12 is provided near a lower central portion of the lower cutter 9. The connecting lever 10 is pivotably mounted to the lower cutter 8 by means of a pin 13 received in bush bearing 11 and is further pivotably mounted to the lower cutter 9 by means of a further pin 13 received in bush bearing 12. In the exemplary embodiment depicted in FIGS. 4 to 5*b*, the connecting lever 10 comprises a receiving section at one end into which of the bush bearing 12 is inserted.

With the connecting lever 10 pivotably attached to the lower cutter 8 and to the lower cutter 9, the connecting lever extends substantially parallel to the first direction D1 over approximately half of the length of the lower cutters 8, 9. Thus, movement of the lower cutter 8 in the first direction D1 is transmitted to the lower cutter 9.

Optionally, the lower cutters 8, 9 may be movable with respect to the frame 6 in further directions, i.e. not only in the first direction. For example, the lower cutters 8, 9 may be guided in the frame 6 permitting an individual floating movement of each lower cutter 8, 9 against the bias of a spring member (not shown) in a direction perpendicular to the first direction, e.g. parallel to the second rotary axis II. FIG. 5*a* shows both lower cutters 8, 9 in an idle state, i.e. pushed upwards (as seen in the Figure) by the spring member. In this idle state, the lower cutters 8, 9 have an orientation substantially parallel to each other.

FIG. 5*b* shows the first lower cutter 8 depressed against the bias of the spring member at its left end (as seen in the Figure), while the second lower cutter 9 is not depressed, i.e. still in the idle state. This results in the first lower cutter 8 being tilted with respect to the second lower cutter 9 as indicated by the dashed lines in FIG. 5*b*. The hinged attachment of the connecting lever 10 to the first lower cutter 8 and to the second lower cutter 9 permits this tilting movement of the lower cutters with respect to each other while still transmitting movement of the lower cutter 8 in the first direction D1 to the lower cutter 9.

A comparison of FIGS. 5*a* and 5*b* further shows that a relative movement between the first lower cutter 8 and the second lower cutter 9, e.g. a tilting movement or a floating movement, results in a relative movement of the first lower cutter 8 and the second lower cutter 9 in the first direction D1 due to the connecting lever performing a swiveling movement about the bearing point defined by bush bearing 12 and pin 13, thereby reducing the axial distance between bush bearing 11 and bush bearing 12 in the first direction D1. In other words, individual tilting or floating results in a brief displacement of the second lower cutter 9 with respect to the first lower cutter 8. This displacement may be kept small by making the connecting lever 10 relatively long, e.g. about 50% of the length of one of the lower cutters, as depicted in the Figures.

The above connecting lever mechanism may be implemented in shaver heads with two, three, four, five, six, seven and eight cutting units or other functional drivable elements in order to dynamically connect a motor driven cutting unit or part of a cutting unit with any other cutting unit which is e.g. not otherwise linked to the motor drive. It is also possible to connect not only one cutting unit or part of a cutting unit but also several cutting units by means of additional connecting levers in order to drive all cutting units which are not otherwise linked to the motor drive.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

REFERENCE NUMERALS

1 housing (shaver handle)
2 head
3 driven shaft
4 foil type cutter unit
5 non-foil type cutter unit
6 frame
7 bridge
8 first actuation member (lower cutter)
9 second actuation member (lower cutter)
10 connecting lever
11 bush bearing
12 bush bearing
13 pin
I first rotary axis
II second rotary axis
D1 first direction

What is claimed is:

1. An electrically driven device for removing hair comprising a housing, an application head movably mounted on the housing, an electric motor mounted in the housing and comprising a drive shaft having a first rotary axis, a driven shaft for performing a movement relative to the housing, the driven shaft extending at least partially within the application head, wherein the driven shaft is indirectly coupled to the drive shaft by a gear mechanism converting a rotary motion of the drive shaft into a reciprocating motion of the driven shaft in a first direction, and a first actuation member comprising a cutter and a second actuation member, wherein the actuation members are movably guided in the application head and wherein the first actuation member comprises a seat receiving a portion of the driven shaft for driving the first actuation member in the first direction, wherein the first actuation member is coupled to the second actuation member by a connecting lever for driving the second actuation member in the first direction, wherein the connecting lever is pivotably mounted to the first actuation member and is pivotably mounted to the second actuation member and the second actuation member is not directly connected to the driven shaft.

2. The electrically driven device according to claim 1, wherein the connecting lever is pivotably mounted to the first actuation member by a pin extending substantially perpendicular to the first direction and is pivotably mounted to the second actuation member by a pin extending substantially perpendicular to the first direction.

3. The electrically driven device according to claim 1, wherein, in an idle state of the device, the connecting lever substantially extends in the first direction.

4. The electrically driven device according to claim 1, wherein the connecting lever is pivotably mounted to the first actuation member at a lateral end portion of the first actuation member and is pivotably mounted to the second actuation member at a central portion of the second actuation member.

5. The electrically driven device according to claim 1, wherein the connecting lever has a length in the first direction being at least 40% of the length of the first actuation member.

6. The electrically driven device according to claim 1, wherein the driven shaft is mounted on a pivotable bridge of the gear mechanism, wherein the bridge is pivotable about a second rotary axis which is offset with respect to the driven shaft.

7. The electrically driven device according to claim 6, wherein at least one further driven shaft is mounted on the bridge at an opposite position with respect to the second rotary axis wherein the at least one further driven shaft is coupled to at least one further actuation member such that the at least one further actuation member is driven in the direction opposite direction of the first actuation member.

8. The electrically driven device according to claim 6, wherein the first rotary axis is inclined with respect to the second rotary axis.

9. The electrically driven device according to claim 1, wherein the first actuation member and the second actuation member is mounted in the application head movable in a floating direction which is perpendicular to the first direction and parallel to the driven shaft against the bias of an elastically deformable element.

10. The electrically driven device according to claim 1, wherein the first actuation member and the second actuation member are mounted in the application head movable in a tilting direction about an axis which is perpendicular to the first direction and perpendicular to the driven shaft against the bias of an elastically deformable element.

11. The electrically driven device according to claim 1, wherein the application head is movable with respect to the housing in a swiveling direction about an axis parallel to the first direction.

12. The electrically driven device according to claim 1, wherein the first actuation member cutter is a lower cutter of a foil type cutter unit.

13. The electrically driven device according to claim 1, wherein the first actuation member is mounted in a frame which is detachably fixed at the application head.

14. The electrically driven device according to claim 13, wherein the connecting lever is detachable from the application head together with the frame and the actuation members.

15. The electrically driven device according to claim 1, wherein the gear mechanism converts a continuous rotary motion of the drive shaft into an at least substantially sinusoidal reciprocating displacement driven shaft.

* * * * *